United States Patent [19]

Amen

[11] 4,195,390

[45] Apr. 1, 1980

[54] APPARATUS AND METHOD FOR MANIPULATION AND SLEEVING OF TUBULAR MEMBERS

[75] Inventor: Randall M. Amen, Menlo Park, Calif.

[73] Assignee: Scientific Technologies, Inc., San Antonio, Tex.

[21] Appl. No.: 850,289

[22] Filed: Nov. 10, 1977

Related U.S. Application Data

[63] Continuation-in-part of Ser. No. 756,053, Jan. 3, 1977, abandoned.

[51] Int. Cl.[2] ..... B23P 17/00; B21D 39/08

[52] U.S. Cl. ..... 29/421 R; 29/523; 72/58

[58] Field of Search ..... 29/421 R, 523; 72/54, 72/58, 60, 61, 63

[56] References Cited

U.S. PATENT DOCUMENTS

| | | | |
|---|---|---|---|
| 605,195 | 6/1898 | Birtwisle | 72/61 X |
| 1,930,745 | 10/1933 | Fisher | 72/62 |
| 2,861,530 | 11/1958 | Macho | 72/62 |
| 3,006,066 | 10/1961 | Grossen | 29/157.3 B X |
| 3,105,537 | 10/1963 | Foster | 72/369 X |
| 3,328,996 | 4/1967 | Pin et al. | 72/369 X |
| 3,358,489 | 12/1967 | Hutchins | 72/62 |
| 3,896,649 | 7/1975 | Stuart | 72/369 |
| 4,109,365 | 8/1978 | Tygart | 29/421 R |

FOREIGN PATENT DOCUMENTS

| | | | |
|---|---|---|---|
| 1527775 | 1/1970 | Fed. Rep. of Germany | 29/421 R |

*Primary Examiner*—Leon Gilden

*Attorney, Agent, or Firm*—Limbach, Limbach & Sutton

[57] ABSTRACT

A tube expanding apparatus and method are disclosed utilizing a hollow, elastic, tubular bladder, an elongate connection member positioned within the bladder, a pair of end caps sealably connecting the bladder to the elongate member and forming an annular chamber between the bladder and elongate member in between the end caps, and means for providing fluid communication to the chamber for expanding the bladder against a tubular member. The connection member is disclosed as either a rigid tie rod or an axially inextendible, flexible member. The tie rod has reduced diameter portions adjacent each end forming shoulders and threaded portions at the end thereof for threadibly connecting the end caps thereon and clamping the bladder against the shoulders. An engagement means can be provided at one end of the connection member for urging the tubular member toward the opposite end of the connection member. Tubing is deformed by internally pressurizing it to the extent where the material begins to yield and a bending force is then applied. Outer curved tubing is sleeved internally by moving such an internally pressurized tubular sleeve to a given position and then increasing the internal pressure to expand the sleeve to conform to the curved tubing.

8 Claims, 38 Drawing Figures

APPARATUS AND METHOD FOR MANIPULATION AND SLEEVING OF TUBULAR MEMBERS

RELATED APPLICATION

This application is a continuation-in-part of Application Ser. No. 756,053 filed Jan. 3, 1977, now abandoned.

BACKGROUND OF THE INVENTION

The present invention relates in general to a method and apparatus for manipulating tubular members by applying internal radially outward directed pressure.

There are many applications in which it is desired to expand one or more tubular members in another tubular member or fixture. Such applications include the connection of telescoped tubular members of different diameters such as one tubular member in another, a pair of end abutted tubular members inside an outer sleeve of larger diameter and a sleeve in a pair of end abutted tubular members of larger diameter. In other applications, it is desirable to repair or strengthen a tubular member by expanding the tubular member outwardly to a repair sleeve of larger diameter or by expanding a repair sleeve of smaller diameter outwardly to the tubular member. In other applications, it may be desirable simply to expand the tubular member outwardly to secure it in place in a fixture. The expansion of the tubular member can be accomplished by radially expanding the member outwardly beyond its elastic limit against an outer member to produce both a tight fit and/or a strong seal.

Known techniques for tubular expansion include mechanical, explosive, and hydraulic expansion. In mechanical expansion, either a mandrel is drawn through the tube or a set of rollers are rotated in the tube and are caused to expand as they rotate. Mechanical expansion of this general nature is described in U.S. Pat. No. 3,412,565 to Lindsey et al. Typically, the parts of mechanical expanders which supply the forces necessary either to draw the mandrel or rotate the rollers are bulky and must be in close proximity to the work location. In the moving parts of mechanical expanders, heat is generated and wear occurs. Also, undesirable localized stresses can be created. The time required to accomplish a mechanical expansion can be long and the tube that is being expanded must be held firmly in place during the expansion process.

In explosive expansion, a chemical compound, typically in rod form, is placed inside a tube and detonated. The hazards of explosive expansion require careful handling of the compound, remote actuation of the detonation and the possible contamination to the environment. Additionally, it is difficult to precisely control both the magnitude and direction of the force generated in explosive expansion, and often the residue left from an explosive expansion requires extensive clean-up. One application of explosive expansion is described in U.S. Pat. No. 3,710,434 to Daniels et al.

In hydraulic expansion techniques, a fluid is pressurized in a confined area to generate forces desired. One type of hydraulic expansion is described in U.S. Pat. No. 3,897,619 to Thivans in which an inflatable organ or pocket is provided on an expansion device and fluid from a remote source is used to inflate the organ or pocket for deformation. In hydraulic expansion of this type the hazards and clean-up problems of explosive expansion do not exist and the problems of localized stresses, prolonged set-up and operational times and difficulties in holding the tubular member attendant mechanical deformation do not exist. The hydraulic deformation described in the Thivans patent does not permit precise control of an expansion process involving high pressures. Hydraulic expansion of tubular members generally and the beneficial results therefrom are also described in U.S. Pat. No. 1,930,745 to J. P. Fisher. However, that patent contains no disclosure or suggestion of use of an inflatable organ, deformation of tubular members under expansion or sleeving of tubular members.

SUMMARY OF THE INVENTION

The object of the present invention is to provide a hydraulic expansion method and apparatus for precisely controlling expansion of a tubular member including expansion of the tubular member uniformly throughout the desired length of the tubular portion desired to be expanded.

Broadly stated, the present invention to be described in greater detail below, is directed to an apparatus, and the method performed by the apparatus, which includes a hollow, elastic, tubular bladder held on an elongate connection member or tie rod sealably positioned therewithin by means of a pair of end caps with means for providing fluid communication to the sealed interior of the bladder. With the expansion apparatus positioned within a tubular member and hydraulic fluid pumped into the bladder, the bladder will be caused to expand the tubular member beyond its elastic limit or to any other degree desired.

A feature and advantage of the present invention is the precise control afforded by expansion of the bladder which is captured by the end caps on the connection member. With the tube expander of the present invention, it is possible to control the magnitude and direction of force applied to the tubular member by the expansion apparatus and the degree of expansion produced.

In accordance with another feature and advantage of the present invention, the connection member is an axially inextensible member which in one embodiment is rigid and in another embodiment is flexible. The length of the inextendible member determines the precise length of the tubular member that will be expanded. A flexible connection member permits use of the assembly in a bent or curved tube in which another tubular member is to be expanded.

In accordance with another aspect of the present invention, at least one end of the expansion assembly includes means for engaging the end of the tubular member being expanded and preventing undesired protrusion of the bladder. In accordance with this feature of the invention, the radial expansion forces will be applied over the precise desired length of the tubular member being expanded and will account for the longitudinal shrinkage that occurs as the tubular member is expanded.

In accordance with another aspect of the present invention, a method and apparatus are provided for easily deforming tubular members to a desired configuration without the necessity for use of excessive forces during the deformation process and avoiding stresses that would otherwise be produced in the deformed article. In accordance with this aspect of the present invention, an inflatable bladder is inserted in the tubular member and pressurized to the extent where the material of the tubular member begins to yield. At this point, a bending force is applied to the tubular member to bend the tubular member to a desired configuration and the internal pressure is relieved.

In accordance with still another aspect of the present invention, a tubular member, and specifically a curved tubular member, can be internally sleeved at any desired location. Using an expansion assembly with an axially inextendable flexible member inside an inflatable bladder, a repair sleeve can be internally pressurized to change the stresses in the axial direction of the sleeve whereby the tubular member can yield when subjected to bending forces and the entire assembly with the yieldable pressurized sleeve can be moved to the desired position within the other member to be sleeved at which point additional pressure can be applied using the bladder to force the sleeve to conform to the size of the second tubular member.

Other features and advantages of the present invention will become more apparent upon a perusal of the following specification taken in conjunction with the accompanying drawings wherein similar characters of reference refer to similar parts in each of the several views.

DESCRIPTION OF THE DRAWING

In the drawing:

FIGS. 17A–17D are enlarged elongate elevational views, partially in section, schematically illustrating operation of another aspect of the present invention for enlarging a portion of the tubular member illustrated in FIGS. 16D and delineated by line 17—17.

DESCRIPTION OF THE PREFERRED EMBODIMENT

The present invention is useful for manipulating tubular members, either tube or sleeve, for deformation or expansion to an outer tubular member or fixture. While the invention is principally designed for deformation and/or expansion of tubular members from a circular cross-section to a larger circular cross-section, the invention can be used to expand tubular members of other cross-sectional shapes into expanded shapes of other cross-sectional character. For purposes of illustration, the invention will be described with reference to tubular members of circular cross-section.

Figure 1:
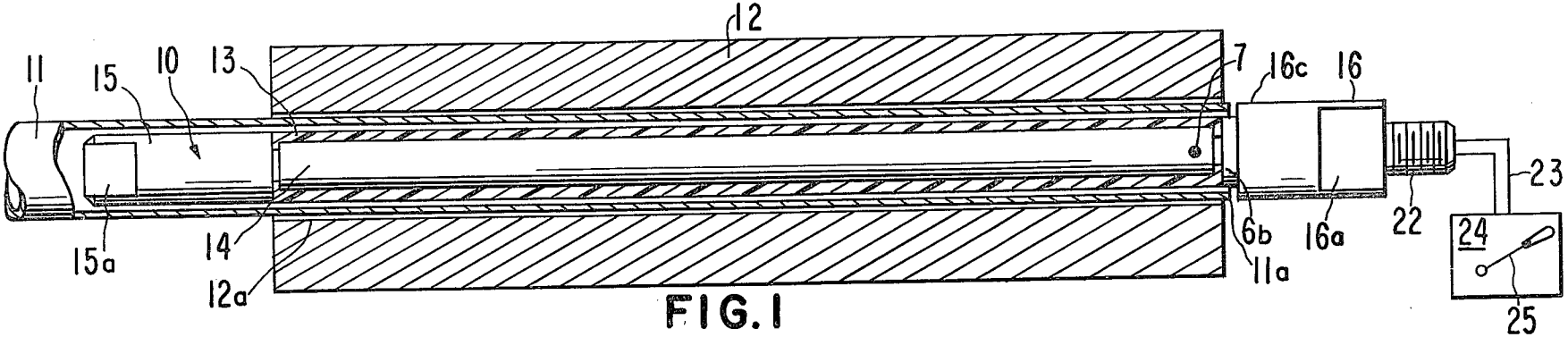
FIG. 1 is a longitudinal sectional view showing one embodiment of the present invention ready for use and schematically illustrating portions of the operable system.

Referring now to the drawing, there is shown in FIG. 1 a longitudinal view, partially in section, of a tube expanding apparatus 10 in accordance with the present invention for expanding a tubular member in the form of a hollow, cylindrical tube 11 in a fixture 12 having a cylindrical bore **12*a*** therein. In the present specification, the word "tube" will refer to a tubular member, a portion of which is expanded to a larger diameter and the word "sleeve" will be used to refer to a tubular member which is expanded to a larger diameter throughout its entire length.

The tube 11 is inserted in the bore **12*a* of fixture 12, typically with the tube end 11*a* slightly protruding from the end of the fixture 12 to allow for the longitudinal contraction of the tube 11** when it is radially expanded.

Figure 3:
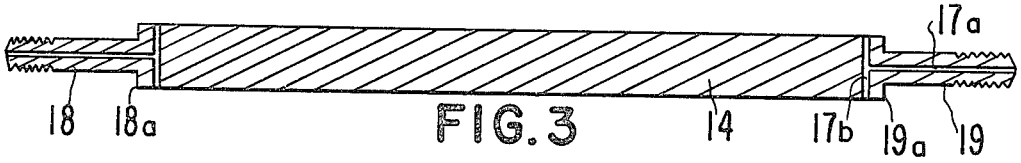

The expander assembly 10 includes an elastic bladder 13 of elastomeric material such as, for example, polyurethane, sealably connected to a tie rod 14 by means of an end cap 15 at the free end of the assembly 10 and an end cap 16 at the fluid inlet end of the assembly. End caps 15 and 16 include wrench flats **15*a* and 16*a* respectively. At the fluid pressure inlet end of the assembly, the tie rod 14 is provided with a fluid channel in the form of an axial bore 17*a* provided at its inner end with a transverse bore 17*b* that ends in ports on opposite sides of the tie rod 14. (See FIG. 3**). An O-ring at the end of the tie rod can be used to seal the threaded portion.

Figure 5:
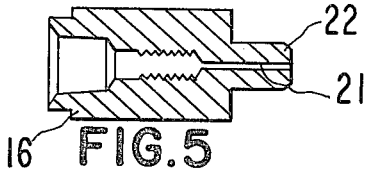
Figure 6:
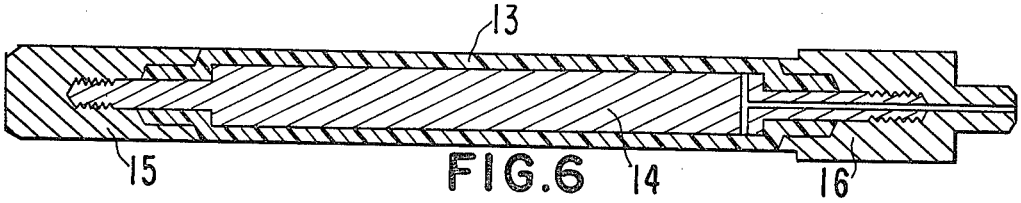
FIG. 6 shows the structures illustrated in FIGS. 2–5 in assembled form.

The tie rod 14 is provided with reduced diameter support portions 18 and 19 at its free end and fluid inlet end, respectively, which portions are threaded at the ends of the tie rod and define shoulders **18*a* and 19*a*. (See FIG. 3). The end caps or members 15 and 16 are both provided with an axial bore thereinto which is threaded at its inner end for mating and sealing with the threads on the reduced diameter rod portions 18 and 19 and which includes a tapered bore portion from a larger diameter at the end of the cap down to a smaller diameter near the internal threads. As shown in FIG. 5, end cap 16 includes a reduced diameter toward the tapered end forming shoulder 16*b* and a fluid passage 21 from the end opposite the tapered bore into the internally threaded bore, and a fluid pressure fitting 22 is provided on that fluid inlet end of end cap 16 for connection via a fluid pressure line 23 to a remote source of pressure such as a hydraulic piston pump 24 having a lever actuator 25**.

The bladder 13 is provided with molded, necked down portions 13*a* and 13*b* at its opposite ends. The bladder is slidably inserted onto the tie rod 14 with the portions 13*a* and 13*b* positioned at the portions 18 and 19, respectively, of the tie rod. The end caps 15 and 16 are then threaded on the tie rod portions 18 and 19 and sealably clamp the bladder 13 to the tie rod 14 at the shoulders 18*a* and 18*b*.

Figure 1A:
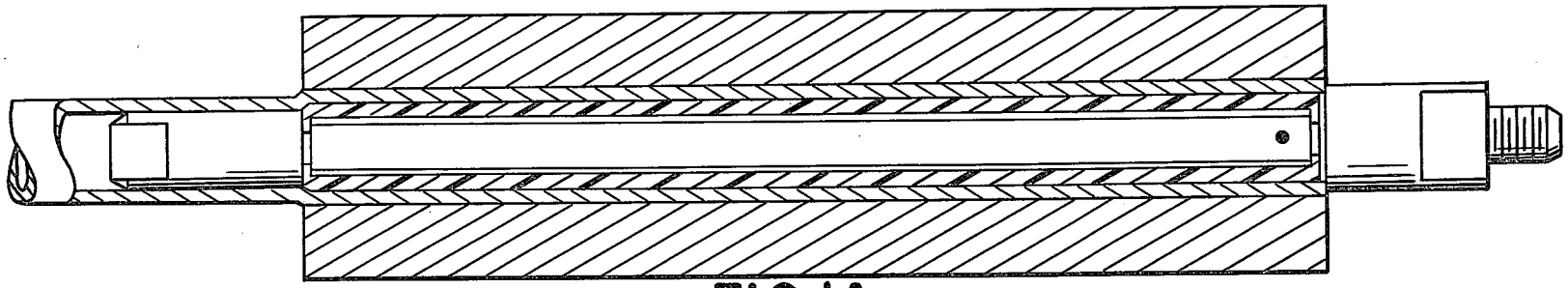
FIG. 1A illustrates expansion performed by the apparatus of FIG. 1
Figure 1B:
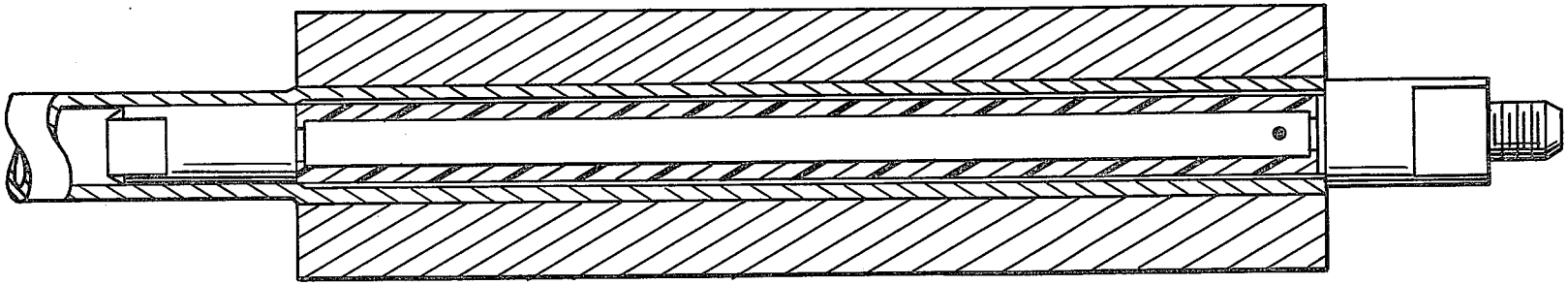
FIG. 1B illustrates the apparatus of FIG. 1 after the expansion performed by the present invention.
Figure 2:
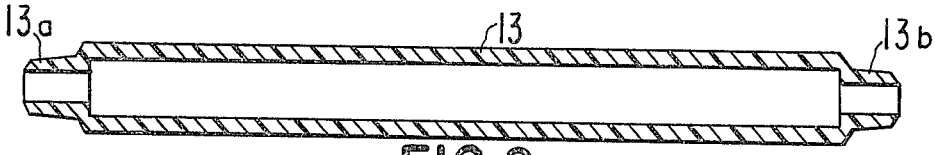
FIGS. 2–5 are sectional views showing portions of the structure of FIG. 1

For expansion of the tube 11, hydraulic fluid is pumped from the source 24 through the line 23, the fluid passage 21 in end cap 16 and the fluid passages 17*a* and 17*b* in the tie rod into the space between the tie rod and the bladder 13. The bladder expands the tube beyond its elastic limit out to the diameter of the fixture 12 as shown in FIG. 1A. The fluid is then withdrawn from the bladder which recovers to its former position as shown in FIG. 1B and the expander assembly is removed.

While it is apparent that the present invention can be used in many applications for expanding tubular members, one principal application for the invention is the expansion of tubes in the assembly of heat exchangers used, for example, in boilers, condensers and steam generators. In such applications, the ends of the tubes in the tube sheets are expanded in the end bulk heads to secure and seal the tubes in place.

Figure 7:
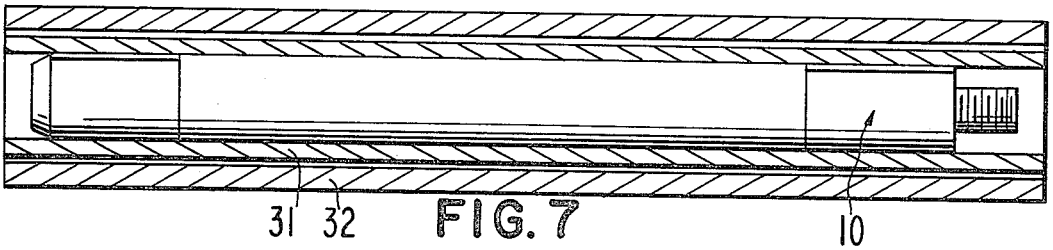
FIGS. 7, 8 and 9 are views somewhat similar to FIG. 1A showing other uses of the present invention.
Figure 8:
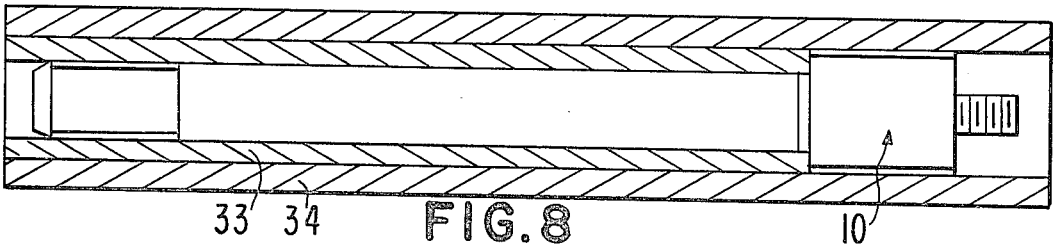
Figure 9:
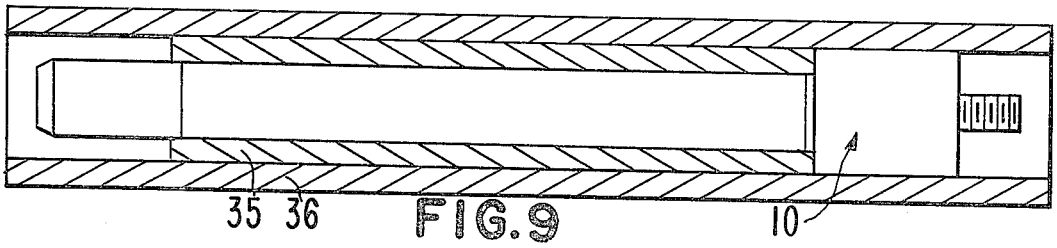

By way of example, other applications of the invention can include the expansion of just the mid portion of a tube 31 positioned within a larger diameter tube or fixture 32 as shown in FIG. 7, the expansion of the end portion of a tube 33 in a larger diameter tube or fixture 34 as shown in FIG. 8 or the expansion of a sleeve 35 in a larger diameter tube or fixture 36 as shown in FIG. 9. The application of the invention shown in FIG. 9 is particularly useful for repair situations for inserting a repair sleeve in a tubular member. There is a great need for the use of the invention in such a repair application to add a repair sleeve to the tubes in heat exchangers of nuclear power plants. The repair sleeves in such applications are typically 36 inches long and are located down inside the heat exchanger. This invention is uniquely applicable to such situations where it is important to minimize the down time of the heat exchanger and avoid contamination problems that could result in leakage of contaminated fluid materials contained within the heat exchanger outside the tube sheets.

While the above description is believed sufficient to enable a person skilled in the art to practice the present invention, a typical example of tubing expanded in accordance with the present invention will be given. A seamless, bendable, metallic hydraulic tubing $\frac{3}{4}''$ diameter and 0.652" inside diameter, 36" long was expanded to the 0.77" inside diameter of a $\frac{7}{8}''$ metal tubing using hydraulic pressure slightly over 5000 psi. A polyurethane bladder having $\frac{5}{8}''$ outside diameter and $\frac{1}{2}''$ inside diameter was mounted on a steel tie rod $\frac{1}{2}''$ in diameter with reduced diameter end portions of $\frac{3}{8}''$ onto which end caps were threaded to cover the ends of the polyurethane bladder which were molded to the $\frac{3}{8}''$ tie rod. The expansion process can be accomplished with the end caps screwed onto the tie rod finger tight and clamping the bladder. With another fixture this expansion assembly was pressurized to over 13,500 psi without failure.

Figure 3A:
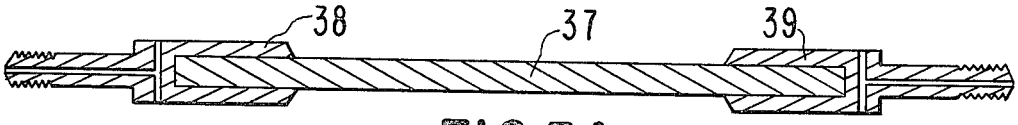
FIG. 3A is a view similar to FIG. 3 and showing an alternative embodiment of the present invention.

While the tie rod has been illustrated as a rigid member, I have discovered that it is possible and useful in accordance with other aspects of the present invention as described below to have the tie rod in the form of an axially inextendiable flexiable member 37, such as steel cable connected to end members 38 and 39 which are provided with the reduced diamater threaded end portions to receive the end caps as shown in FIG. 3A. With this flexible tie rod, it is possible to place the expanding device in a bent or curved tube or fixture and expand a sleeve.

Figure 10A:
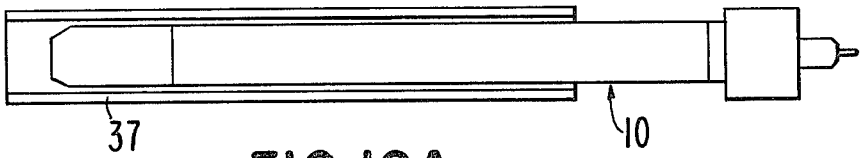
FIGS. 10A–10E are elongate elevational views, partially in section, schematically illustrating operation of the present invention and in accordance with one method thereof.
Figure 10B:
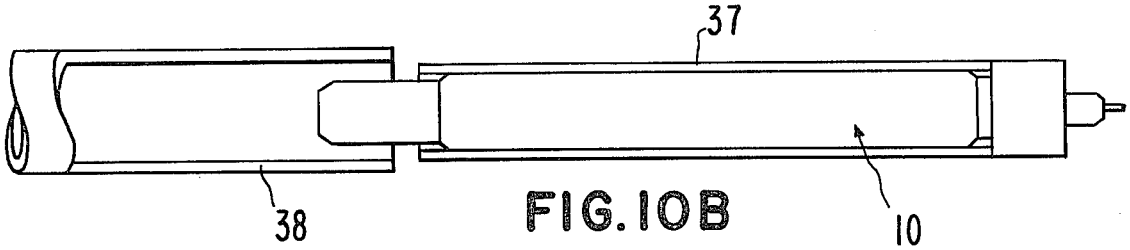
Figure 10C:
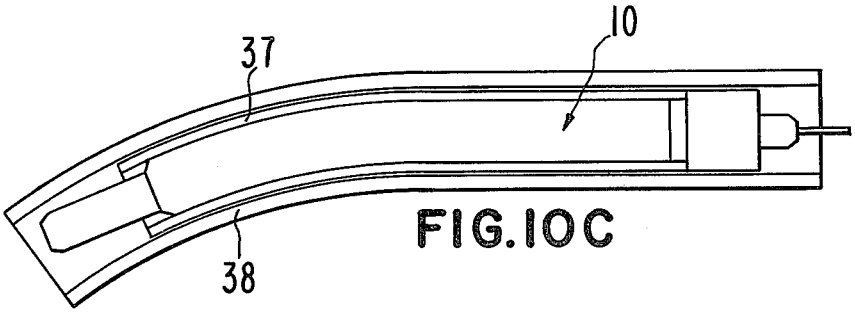
Figure 10D:
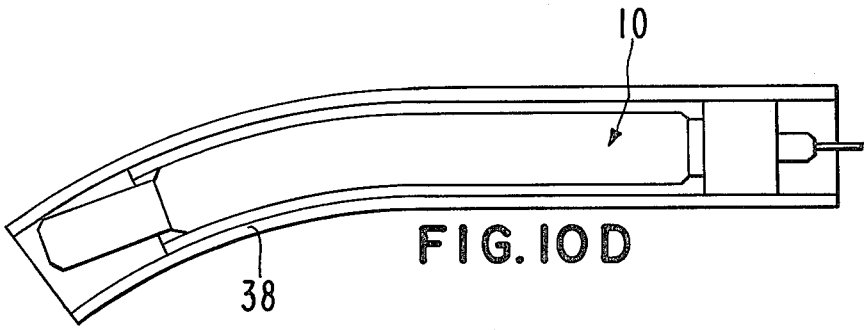
Figure 10E:
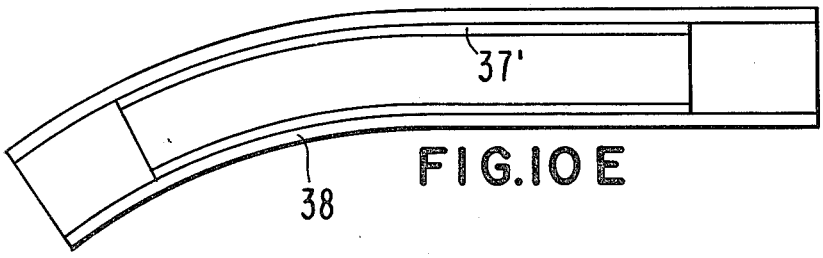

Referring to FIGS. 10A–10E, there is shown use of the present invention with an axially inextendible, flexible tie rod such as shown in FIG. 3A. As shown in FIG. 10A, the expander assembly 10 is slidably inserted in a sleeve 37. As shown in FIG. 10B, the expander assembly is expanded to the elastic limit of the sleeve 37 for insertion of the expander assembly and sleeve into a bent tube 38. At the elastic limit, the sleeve 37 can be permanently deformed, and with the flexible tie rod the assembly can be inserted into a bent or curved tube or fixture and the assembly can deform with the form of the tube or fixture. As shown in FIG. 10C, the expander assembly can be inserted into the tube 38 and with the flexibility of the tie rod and the sleeve 38 at its elastic limit, the assembly will curve with the bend in the tube 38. The expander assembly is then operated to expand the bladder and the sleeve 37 as shown in FIG. 10D and then the hydraulic pressure is reduced in the expander assembly and the expander assembly removed, leaving the expanded sleeve 37' in place in the tube 38, as shown in FIG. 10E.

The expander assembly can be mounted for operation on the end of a rod provided with a handle or may be dropped down into an assembly simply by holding onto a flexible, hydraulic fluid hose connected to the fluid inlet end of the expander assembly. In the mechanized operation of the invention for expanding the ends of tubes in tube sheets as described above, the expander can be provided on a handle provided with a trigger that automatically delivers the desired amount of fluid pressure to the bladder once the expander assembly is in place and the trigger pulled.

Preferably the bladder end is molded so that it is slightly larger than the cavity created by the tie rod and the end cap. When pressurized, forces are created generally axially outwardly toward the ends of the tie rod pushing the bladder harder into the cavity. With the cavity tapered by reason of the tapered bore in the end cap, the seal created between the bladder and tie rod becomes stronger as the pressure increases.

The assembly in accordance with the present invention described above, provides an extremely high pressure expander for tubular members. Relatively long tube lengths can be expanded in one step. The non-compressibility of the hydraulic fluid provides no chance of explosion and the hydraulic pressure is precisely contained, directed and controlled. The hydraulic pressure is evenly distributed over the tubular member being expanded. There are no moving parts and no friction, no heat and no wear generated in the expander itself. There is no material to be cleaned up at the end of the expansion and the tube being expanded need not be held firmly in place during expansion.

It has been discovered that the present invention can be used to aid in the formation of straight tubing into configurations other than straight. In accordance with this aspect of the invention, an expander assembly can be provided in a portion or throughout the entire length of a tubular member and the bladder pressurized and expanded against the tubular member.

Figure 14A:
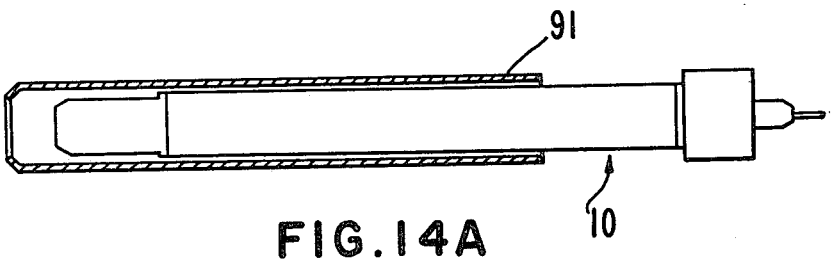
FIGS. 14A–14D are elongate elevational views, partially in section, schematically illustrating another aspect of the present invention for the deformation of straight tubing into a desired configuration other than straight.
Figure 14B:
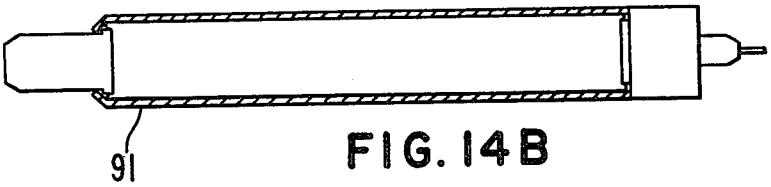
Figure 14C:
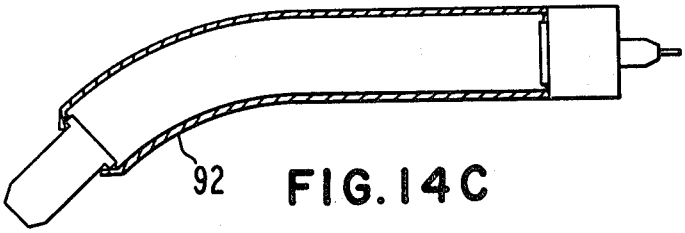
Figure 14D:
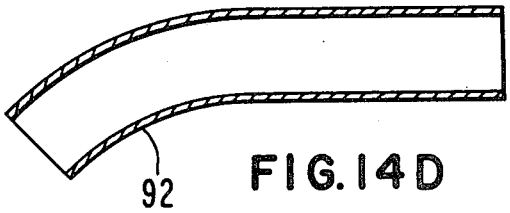
Figure 15A:
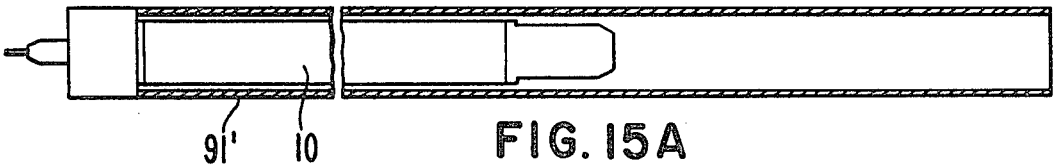
FIGS. 15A–15D are views similar to FIGS. 14A–14D, but wherein the expansion assembly is applied only to one portion of an elongate tubular member.
Figure 15B:
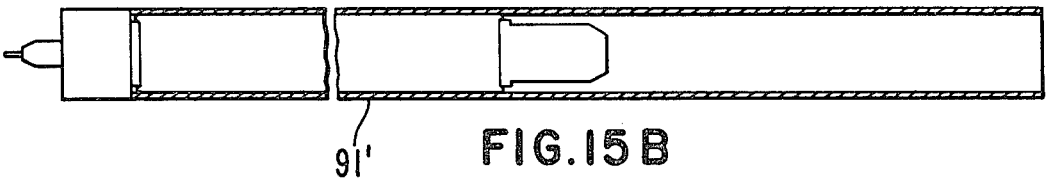
Figure 15C:
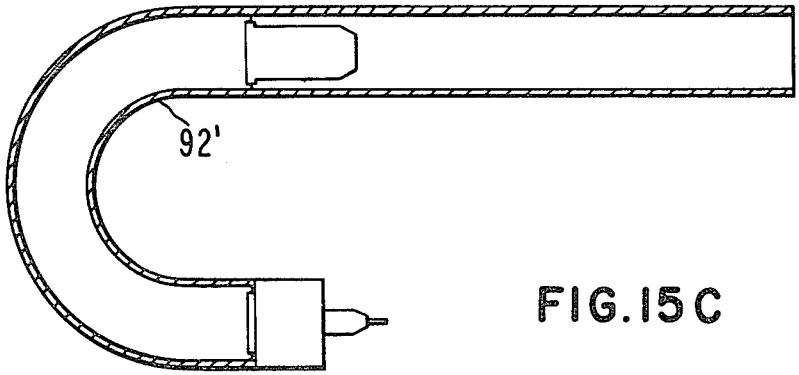
Figure 15D:
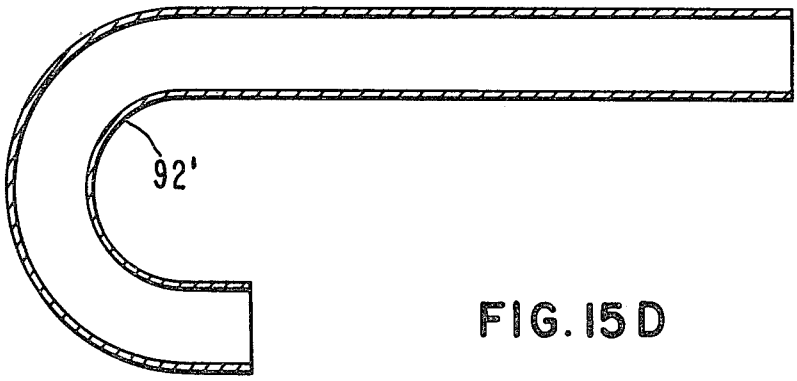

The circumferential stress and deformation, produced by the internal pressure, induces compressive stresses in the axial direction as the axial stresses approach the compressive yield point the material becomes easily deformable such as by an additional external bending force. The tube with the expander bladder therein is then deformed to the desired configuration at which point the bladder is depressurized and removed. This aspect of the present invention is illustrated in FIGS. 14A-14D. As shown therein, an expander assembly 10 with an axially inextendable flexible tie rod, is inserted into a tubular member 91, typically with its remote end turned down to capture the free end of the expander assembly. The expander assembly 10 is then pressurized to expand the tube 91 toward the range of its elastic limit until the tubular member 91 becomes easily deformable as schematically illustrated in FIG. 14B. The tubular member with the expander assembly 10 inside is then deformed to the desired configuration for the ultimate tubing designated as 92 in FIG. 14C. The expander assembly is then depressurized and removed leaving the deformed tubing 92 in its desired configuration. While the invention has been described with respect to FIGS. 14A–14D for the expansion of the entire length of tubing, the invention can also be utilized for deformation of tubing by expansion of only a portion thereof, either centrally or toward one end thereof as shown in FIGS. 15A–15D where similar characters of reference to those shown in FIGS. 14A–14D are utilized but the tubular member 91' in its unexpanded form and 92' in expanded form is much longer than the length of the expander assembly.

Figure 12:
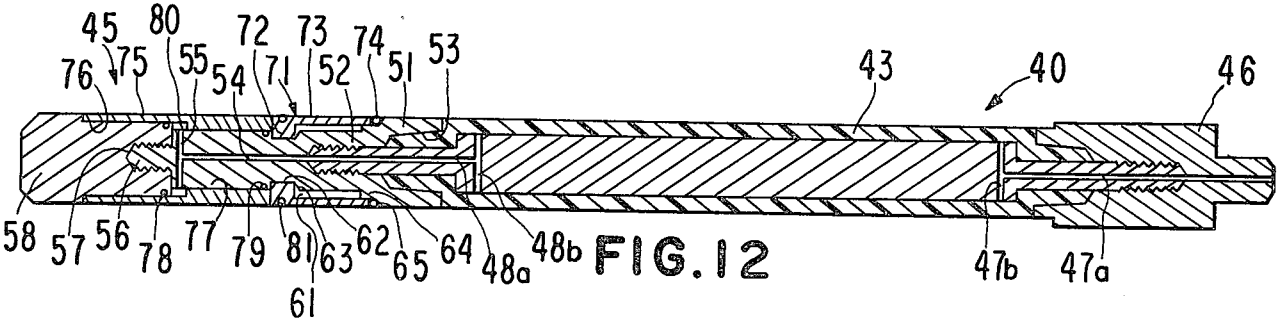
FIG. 12 is a longitudinal, sectional view of the structure shown in FIG. 11 taken along line 12—12 in the direction of the arrows.
Figure 13:
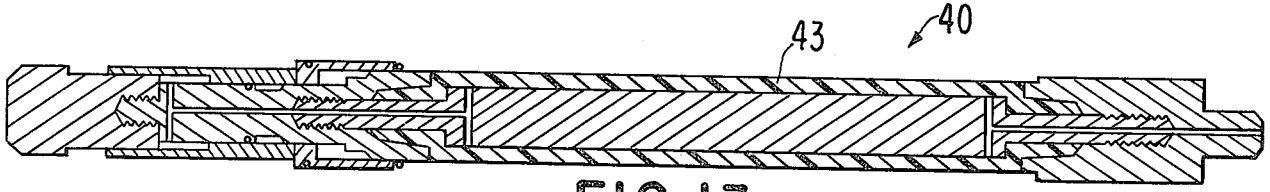
FIG. 13 is a view similar to FIG. 12 illustrating operation of the device shown in FIG. 12.

In many instances, it is desirable to have the tube or sleeve which is being expanded expand uniformly right up to the very end of the tube or sleeve. In order to accomplish this, consideration must be given to the fact that as the tube or sleeve expands radially, it contracts longitudinally. When the contracted length of an expanded tube approaches the length of the bladder, care must be taken to avoid having the bladder bulge out beyond the end of the inner tube which is being expanded. In the embodiment of FIGS. 1–6 with the tubular member 11 placed against the end cap 16, the cap reduced diameter and shoulder **16*b* can insure that no bulge will result. Additionally, to avoid such bulge, another feature of the present invention is the provision of means at at least one end of the expansion assembly for bearing against the tubular member. This structure is illustrated in FIGS. 11–13**.

Figure 11:
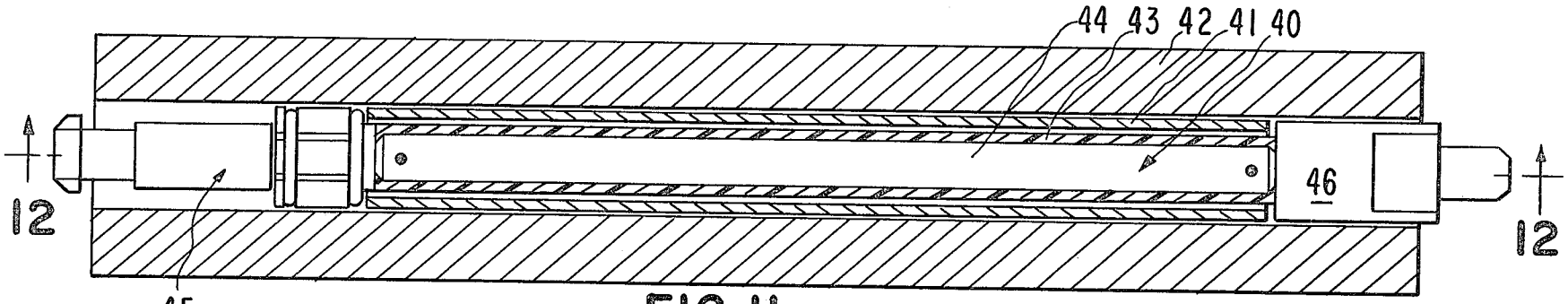
FIG. 11 is a longitudinal sectional view, similar to FIG. 1 but showing another embodiment of the present invention.

Referring to FIG. 11, there is illustrated a tube expander 40 for expanding a sleeve 41 to a fixture 42 utilizing an expandable bladder 43, the ends of which are captured on a tie rod 44 by means of end caps 45 and 46. Hydraulic fluid pressure is supplied to the chamber between the bladder 43 and tie rod 44 by fluid passages **47*a* and 47*b* (see FIG. 12) similar to fluid passages 17*a* and 17*b* in FIG. 3. In this embodiment, at the opposite end of the tie rod 44, a radial fluid passage 48*b* communicates with an axial fluid passage 48*a* for conducting hydraulic fluid into the end cap member 45 which has an external follower for contacting the end of sleeve 41**.

Figure 4:
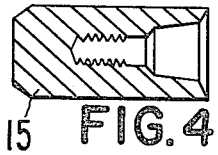

The end cap follower 45 includes an end cap 51 provided with a central threaded bore 52 and a tapered portion 53 similar to the threaded portion and tapered portion of end cap 15 in FIG. 4. From the end of the threaded bore 52, an axial fluid passage 54 communicates with a radially extending fluid passage 55 providing fluid access to the external surface of the end cap 51. Longitudinally beyond the radial fluid passage 55, the end cap 51 is provided with a threaded end 56 which is threaded into a threaded bore 57 of an end member 58.

The end cap 51 is provided with a reduced diameter, exterior slide surface 61 extending from the location of the radial fluid passage 55 toward the tapered bore portion 53 at the opposite end thereof. This reduced diameter slide surface 61 is provided with a portion centrally of the longitudinal length with a further reduced diameter ring surface 62. At the end of the slide surface 61 toward the tie rod 44 there is provided an intermediate diameter surface 64 of a diameter greater than the reduced diameter slide surface 61 and less than the diameter of the outside surface of the end cap 51. The edges 63 and 65 of the reduced diameter ring surface 62 and the intermediate surface 64, respectively, toward the tie rod are tapered.

A plurality of bladder engaging fingers 71 are located around the end cap 51 with each including an inwardly projecting flange portion 72 initially riding in the reduced diameter ring portion 62 of the end cap and an elongate slide portion 73, the end of which initially rests on the intermediate surface portion 64 of the end cap 51. An O ring 74 is positioned on the intermediate surface 64 between the end of the finger slide portion 73 and the tapered shoulder 65 of the end cap.

A hollow cylindrical slide sleeve 75 is provided with a stepped diameter bore having a large diameter portion 76 which rides on a surface of the end member 58 and a smaller diameter portion 77 which rides on the reduced diameter slide surface 61 of the end cap 51. An O ring 78 provides sealing contact between the large diameter 76 and the end member 58 and an O ring 79 provides sealing contact between the small diameter portion of slide 75 and the reduced diameter slide surface of end cap 51 so that there is a sealed chamber 80 between the step in the diameter of slide 75 and the end member 58 in communication with fluid passage 55. A circular spring is provided in a groove on the outside surface of the bladder engaging fingers 71 urging these fingers radially inwardly and holding the inwardly projecting flange portion 72 initially on the reduced diameter ring surface 62 of the end cap 51.

Upon application of pressure from the external source into the space between the bladder 43 and the tie rod 44, hydraulic fluid moves through passages **48*b*, 48*a*, 54 and 55 into chamber 80. The force of this fluid causes the slide sleeve 75 to move axially toward the tie rod 44 causing the fingers 71 to ride up the tapered surfaces 63 and 65 and urging the O ring 44 over the tapered surface 65 and along the external surface of end cap 51 into engagement with the sleeve 41**.

FIG. 12 shows the extendible end cap 45 in initial position and FIG. 13 shows the end cap partially moved toward the position where it will contact the sleeve 41. The end cap 46 need not include the reduced diameter portion and shoulder **16*b* on end cap 16 since the action of end cap 45 will hold the sleeve 41 and end cap 46** in contact.

Figure 16A:
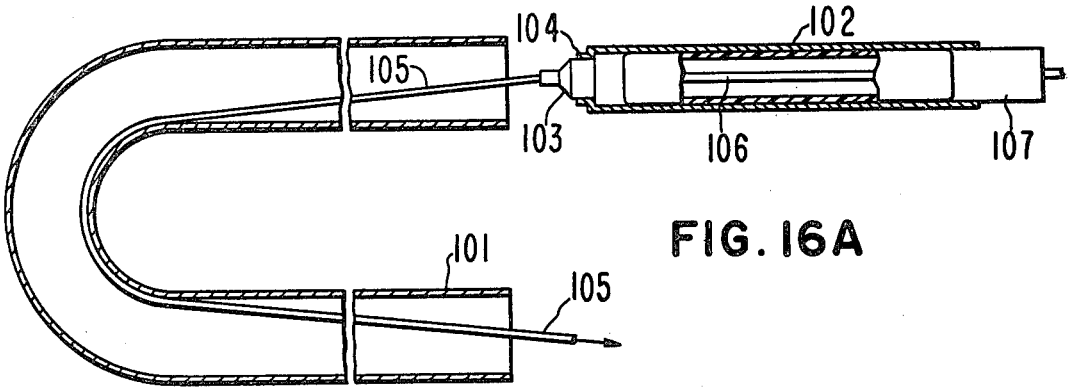
FIGS. 16A–16D are elongate elevational views, partially in section, schematically illustrating operation of another aspect of the present invention for internally sleeving a curved tubular member.
Figure 16B:
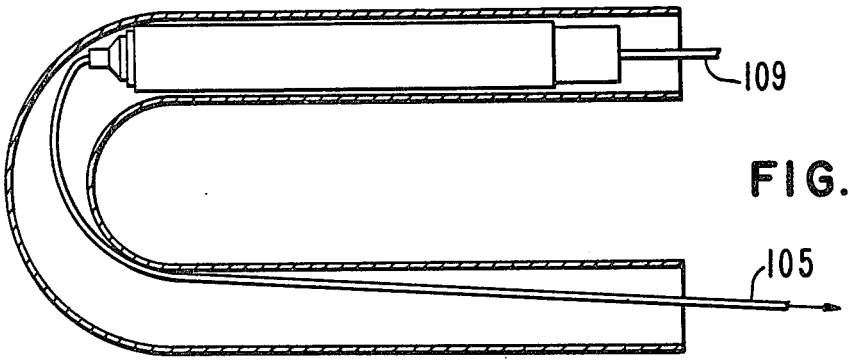
Figure 16C:
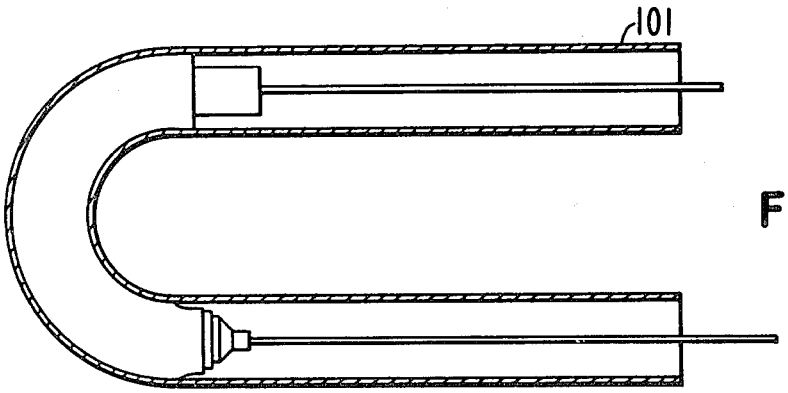
Figure 16D:
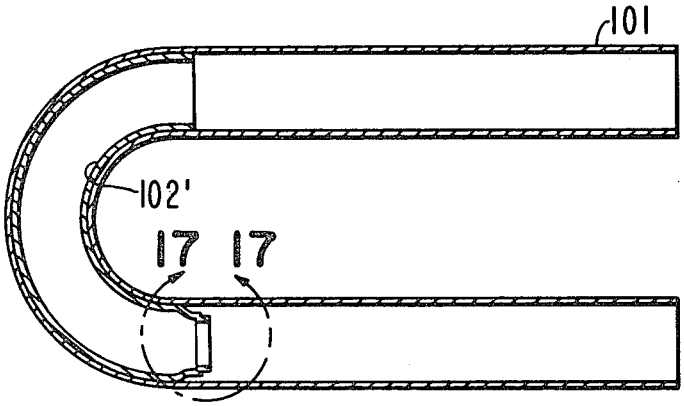

While it is believed that the present invention has been described above and illustrated in the accompanying drawings in sufficient detail to enable a person of normal skill in the art to utilize the invention, a detailed illustrative embodiment will now be given with respect to sleeving of a "U" shaped tube as schematically illustrated in FIGS. 16A–16D. As there illustrated, a U-shaped tube 101 such as utilized in the heat exchanger of a nuclear steam generator and having an outside diameter of 0.875" and an inside diameter of 0.777" and of "INCONEL 600" material has an inside radius of the U-bend of 6". The tube 101 is sleeved internally utilizing the present invention with a type 304 stainless steel, fully annealed sleeve 102 having an outside diameter of 0.657" and inside diameter of 0.589" and 22" length. The sleeve 102 is assembled on an expander assembly provided with an end cap 103 having a step in the diameter onto which the free end of the sleeve 102 is turned down at 104. The end cap 103 is provided with a connection loop 104' connecting a pulling cable 105 to be described in greater detail below. The expander has an inextendible flexible tie rod 106 in the form of a non-rotating aircraft steel cable connecting the end cap 103 to the opposite end cap 107 and for capturing a polyurethane bladder 108 having a 9/16" outside diameter and 7/16" inside diameter. The pulling cable 105 is inserted into one leg of the U-tube 101 around the bend, out the other leg and attached to the attachment portion 104 of the end cap 103. The cable is pulled until the sleeve reaches the curve as illustrated in FIG. 16B. A force such as on the order of 200 lbs. is applied to the cable to draw the sleeve through the U-tube when the sleeve 102 is caused to yield. The bladder 108 is pressurized with hydraulic fluid from the line 109 and inflated until the sleeve material yields such as in the range from 3500 to 6500 psi. The sleeve becomes flexible enough for the force on the cable to pull the sleeve 102 into the curve of the U-tube 101. Once the cable has been pulled the desired length to bring the sleeve to the desired position in the U-tube, the force on the cable is removed. The bladder pressure is increased upwards to on the order of 10,000 psi to expand the sleeve against the tube as shown in FIG. 16C. The bladder pressure is removed and the expander assembly 100 withdrawn as shown in FIG. 16D. The ends of the expanded tube 102' are not as fully expanded as the remainder of the tube and can be expanded by an end expander of any of a number of well known forms to seal the sleeve to the U-tube or prepare for welding. The ends of the expanded sleeve 102 can be welded by a ring welder to ensure a seal.

Alternative devices for expanding the very end of the tube are illustrated in FIG. 17.

Figure 17A:
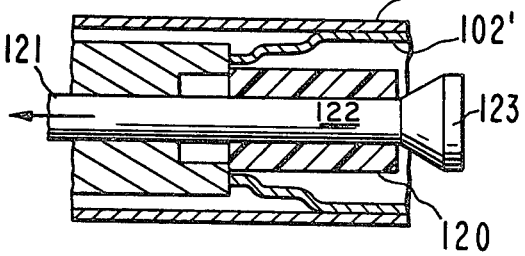
Figure 17B:
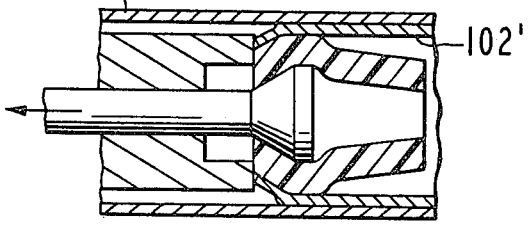
Figure 17C:
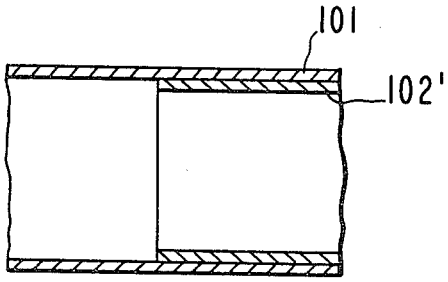
Figure 18A:
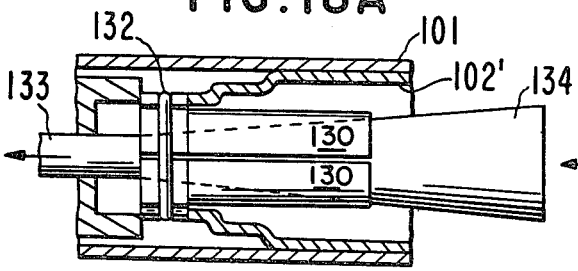
FIGS. 18A–18C are views similar to FIGS. 17A–17C illustrating another alternative embodiment of the present invention.
Figure 18B:
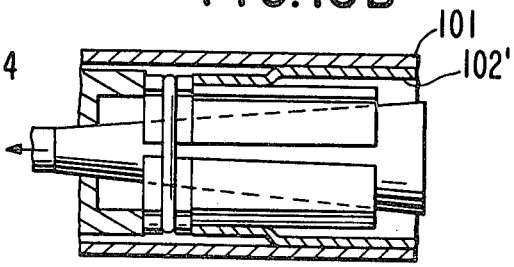
Figure 18C:
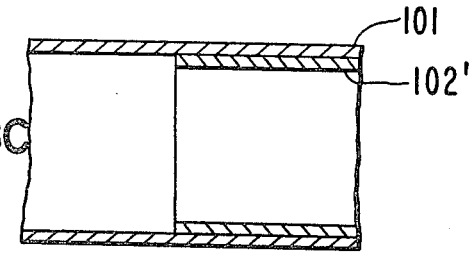

In FIGS. 17A and 17B there is illustrated apparatus and method of expanding the very end of the previously expanded tube in the U-tube 101 using a deformable plastic member. As illustrated there, a deformable plastic member 120 such as of acetal is positioned on an expanding mandrel 121 that has an elongate central section 122 of a diameter to slide through the hollow cylindrical plastic sleeve 120 and with the mandrel 121 sliding through and abutment fixture 124 which is held against the free end of the tubular member 102'. An enlarged end portion 123 is provided on the trailing end of the mandrel 121 with a diameter tapering from the diameter of the central portion 122 to an enlarged diameter sufficient to force the plastic sleeve 120 outward against the end of the deformed sleeve 102' to cause the end of sleeve 102' to conform to the diameter of the U-tube 101. The mandrel 121 is pulled through the hollow sleeve 120 as illustrated in FIG. 17B and the plastic sleeve 120 removed after the mandrel has been pulled through leaving the end of the sleeve 102' expanded to the diameter of the U-tube 101 as illustrated in FIG. 17C.

An alternative construction for an end expander is illustrated in FIGS. 17D, E and F, similar to FIGS. 17A, B and C, but wherein the expandable portion that effectively causes deformation of the end of the sleeve 102' consists of a plurality of brass segments 130 which form a hollow cylindrical sleeve when they are held together such as by an O-ring 132 in a groove around the outside surface of the segments 130. As the mandrel 133 which is provided with a tapered diameter enlarging in the trailing direction is pulled through the segments and an abutment fixture 135, the enlarged trailing end 134 causes the segments to move radially outward and deform the end of the sleeve 102'.

It can be appreciated that in accordance with the present invention, a sleeve can be pushed or pulled into a tubular member that is to be internally sleeved.

It has been discovered that when a sleeve is to be slid within a tube such as in the embodiment illustrated in FIGS. 16A–16B, it is helpful to provide a bearing surface material on the outside of the sleeve. One material has been found to be the use of a dissimilar appropriate metal such as copper for the materials illustrated in the embodiment of FIG. 16 to reduce the galling and friction and also to reduce the corrosion by bi-metallic coupling between the sleeve and the U-tube.

Although the foregoing invention has been described in some detail by way of illustration and example for purposes of clarity of understanding, it is understood that certain changes and modifications may be practiced within the spirit of the invention as limited only by the scope of the appended claims.

I claim:

1. The method of expanding a tubular member comprising the steps of:
   - inserting an elongate, hollow cylindrical inflatable bladder into the tubular member;
   - clamping the ends of said bladder to an elongate tie rod in end cavities tapering inwardly in a direction longitudinally of the bladder toward each end;
   - forcing the ends of said bladder into said cavities with pressure applied internally of the bladder thereby sealing said bladder around said tie rod and limiting the expandable length of said bladder; and
   - applying internal pressure to expand said bladder and to apply only substantially radially outwardly directed pressure to the tubular member to stress the tubular member at least to the elastic limit in order to deform the tubular member.

2. The method in accordance with claim 1, wherein said expanding step includes;
   - first partially expanding said bladder stress the tubular member to the elastic limit thereof;
   - inserting said partially expanded bladder and the tubular member into a larger, second tubular member; and
   - more fully expanding said bladder to cause the first tubular member to deform to the shape of said second tubular member.

3. The method in accordance with claim 1 including moving a limiting member against the tubular member adjacent that portion where said clamping is applied to said bladder.

4. The method of sleeving a second tubular member with a first tubular member comprising the steps of:
   - inserting an inflatable bladder in the first tubular member;
   - limiting the expandable length of said bladder;
   - partially expanding said bladder to stress the first tubular members to the elastic limit;

moving said partially expanded bladder and the first tubular member to a given position in the larger, second tubular member; and more fully expanding said bladder to cause the first tubular member to deform substantially to the size of said second tubular member.

5. The method of claim 4 including the step of expanding against the second tubular member the ends of the first tubular member where the length of said bladder has been limited.

6. The method of claim 5 including bonding the first tubular member at the ends thereof to the second tubular member.

7. The method of deforming the tubular member having a central axis describing the steps of stressing said tubular member to the elastic limit by applying substantially only pressure thereto directed only substantially radially outwardly of the tubular member;

applying a bending force to said stressed tubular member to bend said tubular member and it's said axis to a different configuration; and relieving the applied internal pressure.

8. The method of claim 7 including the step of:

applying additional internal pressure to expand said tubular member to a limiting configuration.

* * * * *